US009718637B2

(12) United States Patent
Slezak

(10) Patent No.: US 9,718,637 B2
(45) Date of Patent: Aug. 1, 2017

(54) CREEL THREADER AND METHOD OF USE

(71) Applicant: RJS CORPORATION, Akron, OH (US)

(72) Inventor: Arnold G. Slezak, Fairlawn, OH (US)

(73) Assignee: RJS CORPORATION, Akron, OH (US)

( * ) Notice: Subject to any disclaimer, the term of this patent is extended or adjusted under 35 U.S.C. 154(b) by 402 days.

(21) Appl. No.: 14/340,664

(22) Filed: Jul. 25, 2014

(65) Prior Publication Data

US 2015/0048199 A1 Feb. 19, 2015

Related U.S. Application Data

(60) Provisional application No. 61/866,695, filed on Aug. 16, 2013.

(51) Int. Cl.

| | |
|---|---|
| ***B65H 49/32*** | (2006.01) |
| ***B65H 51/18*** | (2006.01) |
| ***B65H 57/00*** | (2006.01) |

(52) U.S. Cl.

CPC ..... *B65H 49/32* (2013.01); *B65H 51/18* (2013.01); *B65H 57/003* (2013.01); *B65H 2701/31* (2013.01); *B65H 2701/36* (2013.01)

(58) Field of Classification Search

CPC ..... B65H 49/14; B65H 49/16; B65H 49/32; B65H 49/324; B65H 51/18; B65H 57/003; D02H 1/00; D02H 13/00

See application file for complete search history.

(56) References Cited

U.S. PATENT DOCUMENTS

| | | | | |
|---|---|---|---|---|
| 3,377,676 | A | 4/1968 | Furst | |
| 4,443,913 | A | 4/1984 | Klazar | 19/159 |
| 4,996,748 | A | 3/1991 | Jornot | 19/157 |
| 5,023,976 | A | 6/1991 | Meyer et al. | 19/0.25 |
| 6,453,513 | B2 | 9/2002 | Duda | 19/236 |
| 2010/0139326 | A1 | 6/2010 | Karbowski et al. | 65/500 |

FOREIGN PATENT DOCUMENTS

| | | | |
|---|---|---|---|
| DE | 41 40 238 A1 | 6/1993 | D01H 13/04 |
| GB | 1137759 | 12/1968 | D02H 1/00 |

OTHER PUBLICATIONS

Search Report mailed Dec. 18, 2014 in corresponding application No. 14002737.6.

*Primary Examiner* — William E Dondero
(74) *Attorney, Agent, or Firm* — Renner Kenner Greive Bobak Taylor & Weber

(57) ABSTRACT

A creel threader for use with a creel system that holds a plurality of spools where each spool carries a filamentary material includes a guide supported by the creel, an endless loop carried by the guide, a drive assembly coupled to the endless loop and at least one gripper carried by the endless loop. The gripper receives the filamentary material from at least one of the spools, and the drive assembly moves the gripper and the received filamentary material from the spool to an output end of the creel system for further processing. Related methods of operation are also disclosed.

18 Claims, 17 Drawing Sheets

CREEL THREADER AND METHOD OF USE

CROSS-REFERENCE TO RELATED APPLICATIONS

This application claims priority of U.S. Provisional Application Ser. No. 61/866,695 filed Aug. 16, 2013, which is incorporated herein by reference.

TECHNICAL FIELD

The present invention relates generally to creel systems. More particularly, the present invention relates to a creel threader and method of use for use in conjunction with a creel system so as to facilitate transfer of filamentary material from any number of spools to another manufacturing station. More specifically, the present invention relates to a creel threader and method of use which automates the transfer of the filamentary material from a spool mounted on the creel to an organizer maintained at an output end of the creel for further use or manufacturing steps.

BACKGROUND ART

Filamentary materials include, but are not limited to, fibers in single and multiple strands, flat bands, or tubing produced in long lengths and conveniently wound on spools. The various filamentary materials may be either natural or synthetic fibers, glass or metal. Filamentary materials may also be referred to as wire, cords or coiled strands. Such materials are commonly utilized as reinforcements for plastic or elastomeric compounds or may themselves be fabricated into integral items as in the textile industry, hose industry or the tire industry. In order to have available in a manageable form substantial lengths of cord, it is commonly known to employ spools upon which the filamentary material is mounted for storage and from which the filamentary material may be paid out by rotation of the spools about the longitudinal axis thereof. Regardless of the application, it is customary to withdraw the filamentary material from the spool at or near the location it is being used. To facilitate such removal, the spool is customarily mounted on a spindle or let-off device which permits the spool to rotate as the filament is withdrawn.

There are various types of manufacturing processes which involve the combination of a plurality of filamentary strands of material which during processing are combined with each other, with other materials or both. Where it is necessary to combine a plurality of such strands of material during either continuous or intermittent manufacturing operations, it is frequently convenient that the strands be coiled such as to provide the capability of continuously feeding out substantial lengths of the strands. One such example of the employment of spools to store and pay out strands is involved in the rubber industry where it is common to simultaneously employ a plurality of steel cords which are stored on and dispensed from spools. The spools are normally mounted in an array which is commonly referred to as a creel. While creels may differ in various details they commonly consist of an array of spindles which are mounted in a substantially vertical frame work having spindles which may project in one or both directions therefrom. The spools typically have a diameter of approximately ten inches and a longitudinal dimension of a foot, although other dimensions may be employed in some instances. The spools have a hollow core which inwardly receives a creel spindle and which outwardly carries steel cord or other filamentary material repetitively coiled within the confines of the spool flanges. Creels commonly array the spindles in rectangular configurations projecting from the framework in arrangements which may conveniently have six spindles high and a multitude of spindles long or in some instances five spindles high and a multitude of spindles long. This type of arrangement places spindles from a position just above the ground to approximately six feet off the ground taking into account the necessary spacing between spindles as a result of the diameter of the spools which may be on the order of ten inches and of the necessary spacing between spindles to effect requisite control over pay out and tensioning of the strands. Spools employed for steel cord are normally of a construction such that, while the spool is of relatively light metal material, the full spool with its capacity of steel cords approaching the radially outer extremity of the flanges may weigh on the order of forty to one hundred pounds.

In order to set up a manufacturing run using prior creel systems, the technician will load all of the spools onto the appropriate spindles. Next, the filamentary material that is maintained on each spool is threaded through a tension controller and then manually pulled to an end of the creel to a filamentary material organizer. The user must ensure that the filamentary material is delivered to the correct position on the organizer so as to ensure that the next manufacturing processes are completed as desired. This process is repeated for all the spools loaded onto the creel. After the filamentary materials are fully loaded into the organizer, they are then taken to a calender or like machinery for further processing.

The current machinery and method of use is problematic for a number of reasons. The primary problem is the manual transfer of the material from the spool to the organizer. Skilled artisans will appreciate that this is a time consuming operation, especially if there are a large number of spools maintained by the creel. In view of this time consuming operation, it is customary for manufacturers to maintain two creel systems side-by-side. Accordingly, as one creel is fully set up and operating, the other creel is loaded and threaded so as to maintain continuous operation of the calender or other similar manufacturing station. In any event, the current manual method of pulling filamentary material from the spools is also problematic in that the steel cords, also referred to as wires, are sometimes misplaced or tangled while being transferred from the spool to the organizer. It is known to use comb-like devices to transfer the filamentary materials from several spools to the organizer. However, only a few wires can be transferred at any one time. This method also is still problematic in that the wires may become tangled or the operator may mis-locate the filamentary material in the comb which later results in the filamentary material being misplaced in the organizer. It will further be appreciated that the pull-off forces of the filamentary material can become substantial which results in difficulty in pulling the cords from the spools maintained on the row closest to the floor and for those spools that are maintained on a top row, which is in most instances is commonly six feet in height.

In view of the shortcomings of the current creel systems, there is a need in the art for an automated creel threader that simplifies the filamentary material organization process, wherein it is desired for the process to be faster, provide less tangling for the filamentary material, provide safety features and improve the overall operation of the creel system. Indeed, there is a need in the art for automated creel systems that reduce labor, and remove difficult and tedious operation.

DISCLOSURE OF INVENTION

In light of the foregoing, it is a first aspect of the present invention to provide a creel threader and method of use.

Another aspect of the present invention is to provide a creel threader for use with a creel system that holds a plurality of spools wherein each spool carries a filamentary material, the creel threader comprising a guide supported by the creel, an endless loop carried by the guide, a drive assembly coupled to the endless loop, and at least one gripper carried by the endless loop, the at least one gripper receiving the filamentary material from at least one of the spools, and the drive assembly moving the at least one gripper and the received filamentary material from the spool to an output end of the creel system for further processing.

Yet another aspect of the present invention is to provide a method of transferring filamentary material carried on spools maintained by a creel to an organizer, the method comprising loading a plurality of spools that carry filamentary material on to a creel, securing the filamentary material from at least one of the spools to at least one gripper, moving the at least one gripper with a drive assembly, and releasing the filamentary material from the at least one gripper.

BRIEF DESCRIPTION OF THE DRAWINGS

These and other features and advantages of the present invention will become better understood with regard to the following description, appended claims, and accompanying drawings wherein:

BEST MODE FOR CARRYING OUT THE INVENTION

Figure 1:
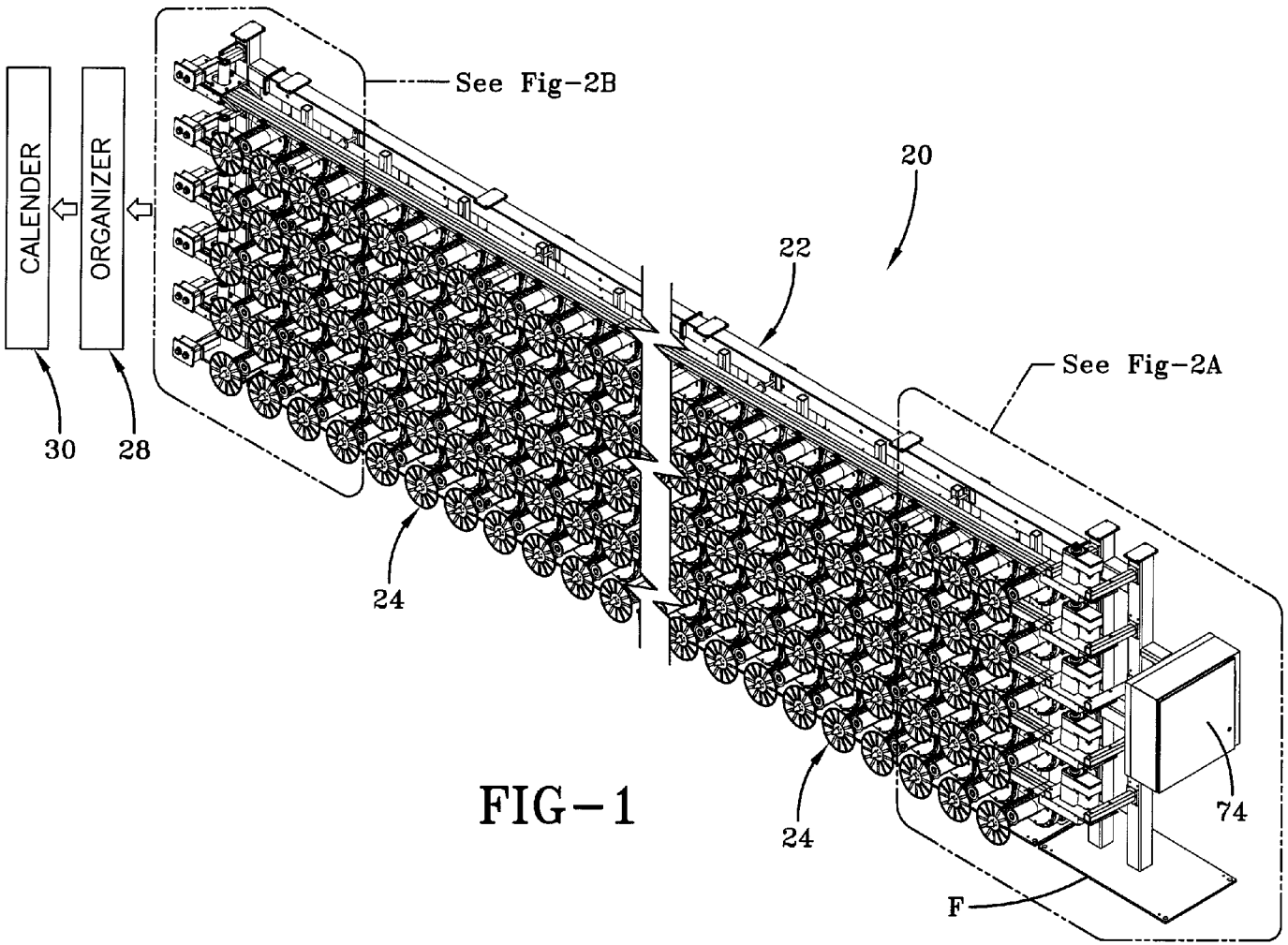
FIG. 1 is a perspective view of a creel system according to the concepts of the present invention.

Referring now to all of the drawings, it can be seen that a creel system is designated generally by the numeral 20. The creel system 20 includes a frame 22 which is made up of horizontal and vertical members connected to one another wherein the entire assembly is secured to a factory floor F. The frame 22 may be otherwise configured. In one embodiment, the frame 22 carries a plurality of spools 24 wherein the spools may be maintained in uniform levels or rows. The number of levels and number of spools maintained by those levels is dependent upon the configuration of the desired end product. Associated at an output end of each level may be an organizer designated generally by the numeral 28. Further downstream from the organizer may be a calender 30 or other piece of processing equipment.

Figure 2A:
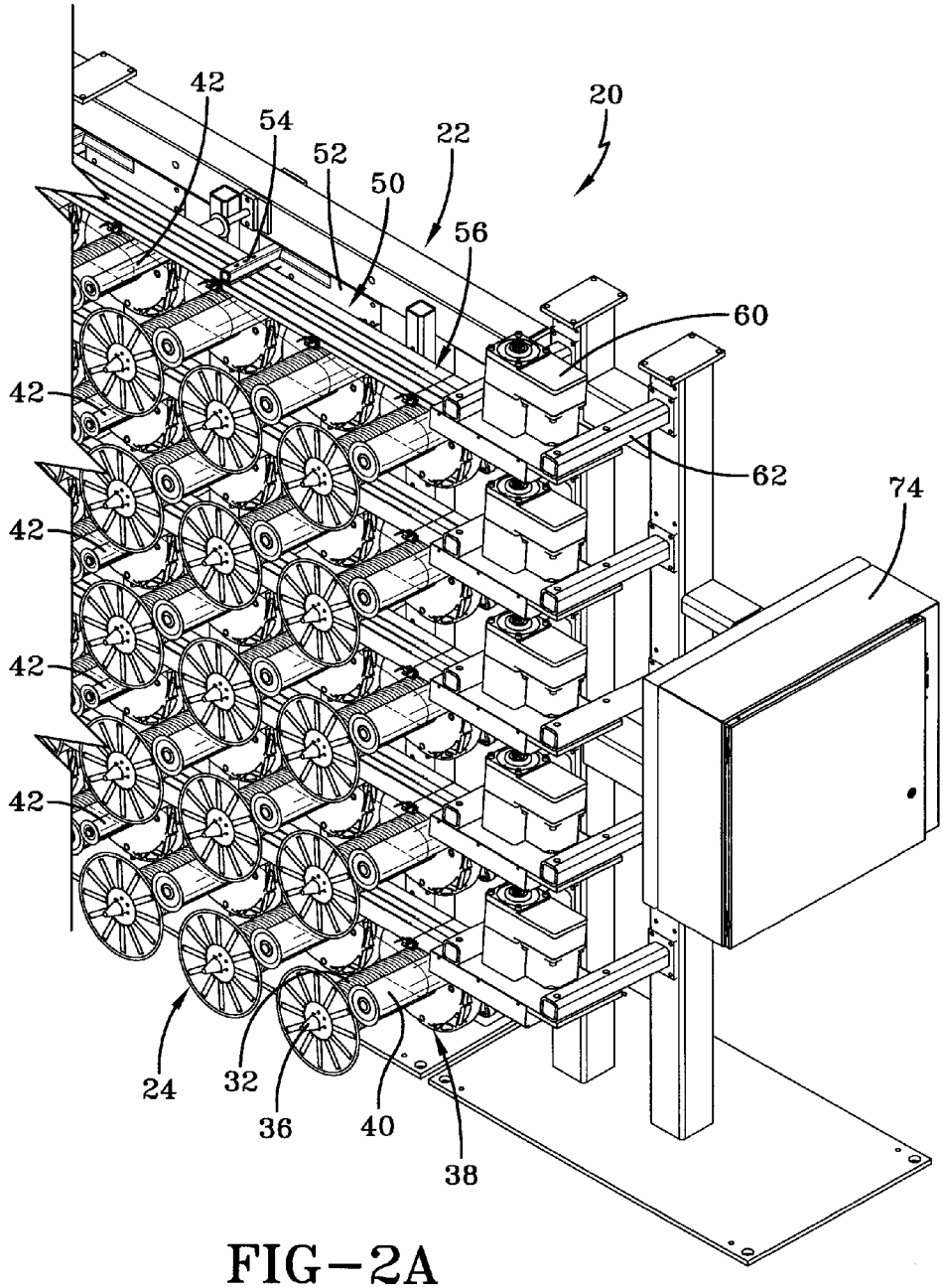
FIG. 2A is a partial perspective view of the creel system according to the concepts of the present invention, and in particular a rear end of the system.
Figure 2B:
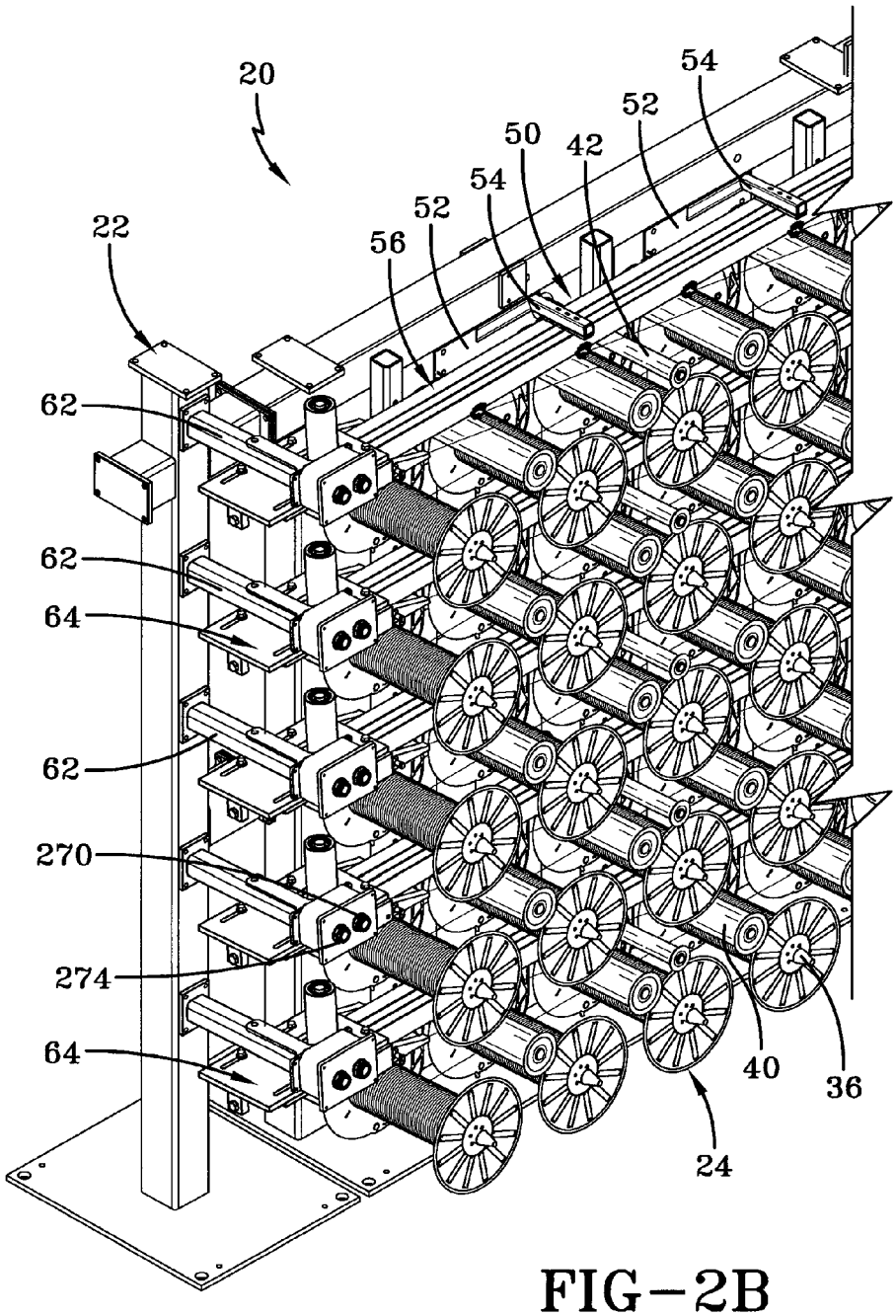
FIG. 2B is a partial perspective view of the creel system according to the concepts of the present invention showing an output end of the creel system.
Figure 3:
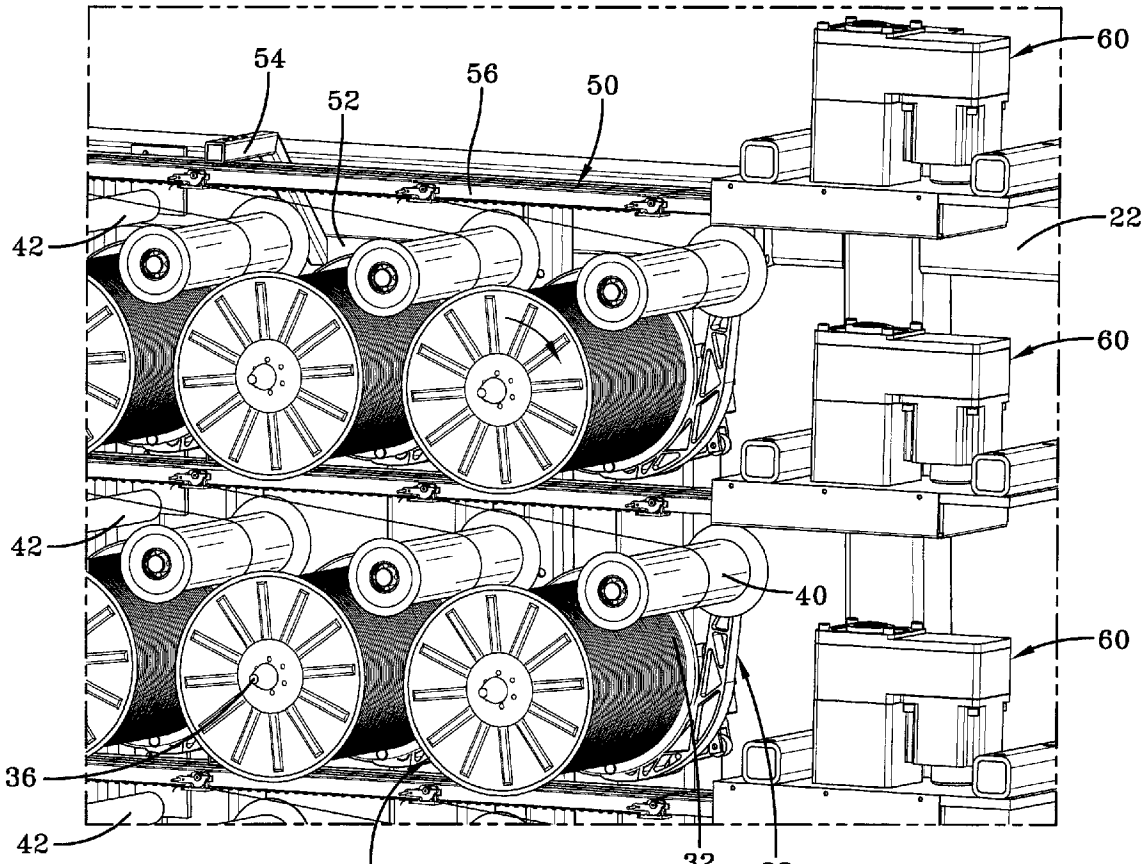
FIG. 3 is a detailed view of the creel system according to the concepts of the present invention showing fully-loaded spools loaded onto the creel.
Figure 4A:
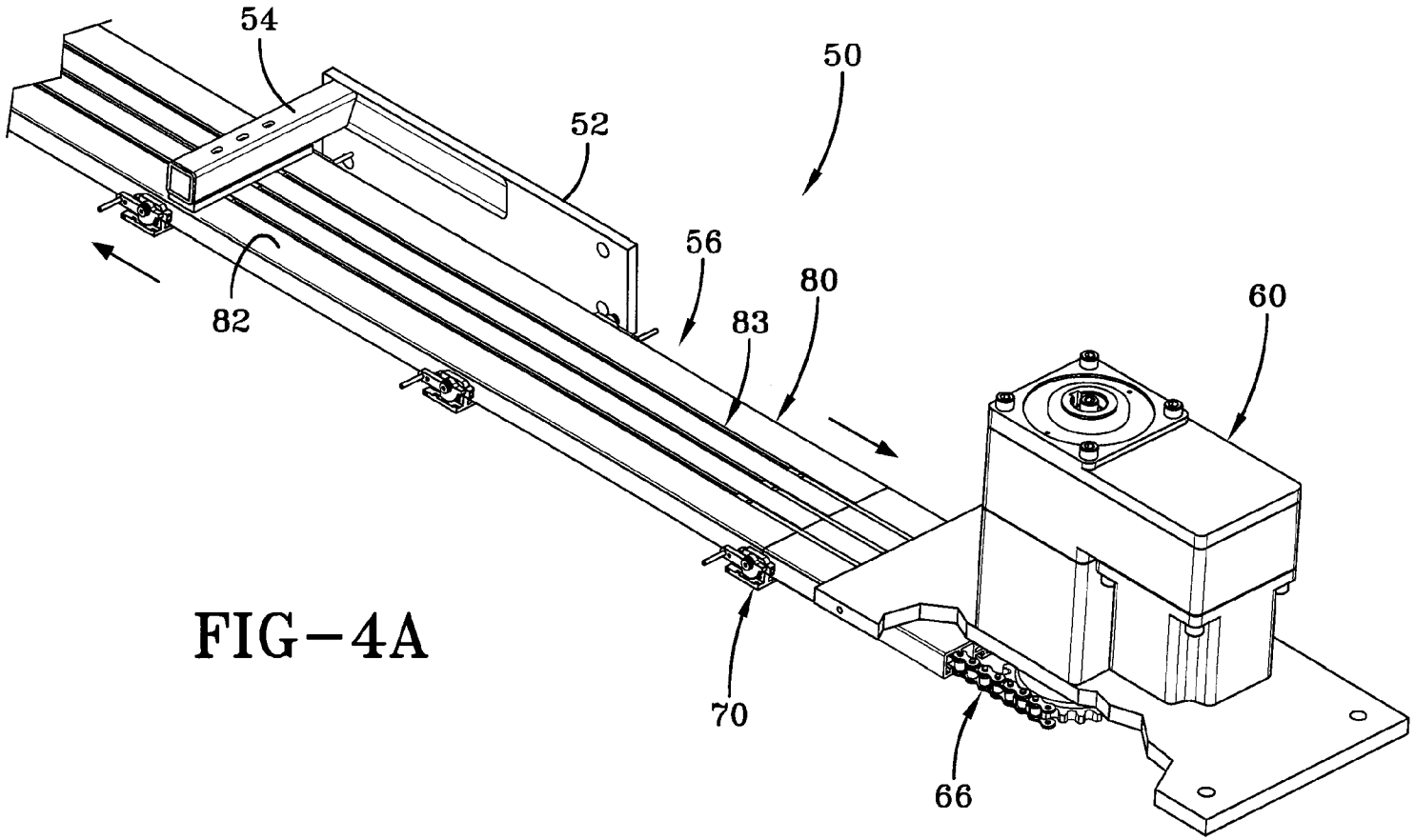
FIG. 4A is a perspective view of one end of a creel threader utilized with the creel system according to the concepts of the present invention.
Figure 4B:
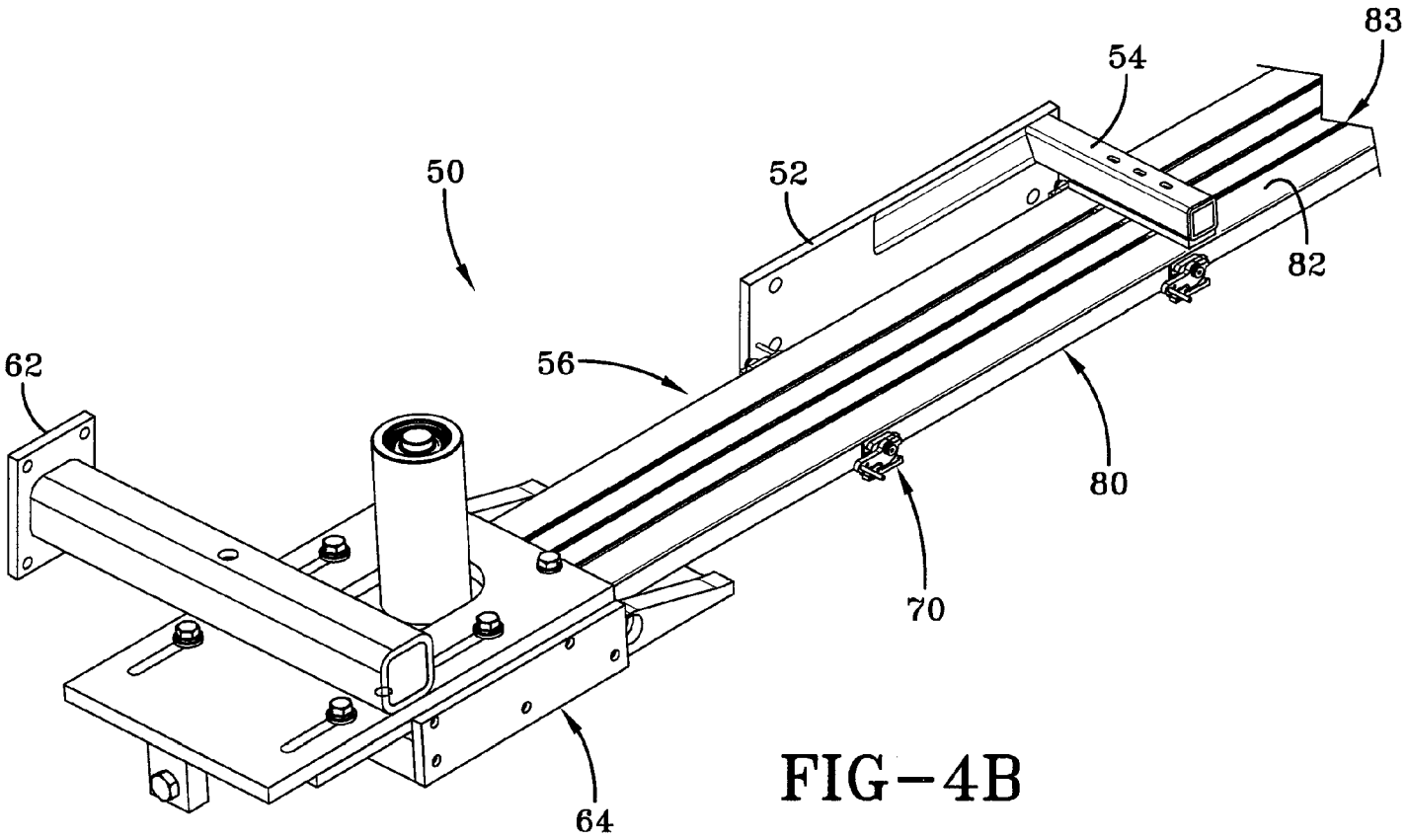
FIG. 4B is a perspective view of an opposite end of the creel threader utilized with the creel system according to the concepts of the present invention.
Figure 5A:
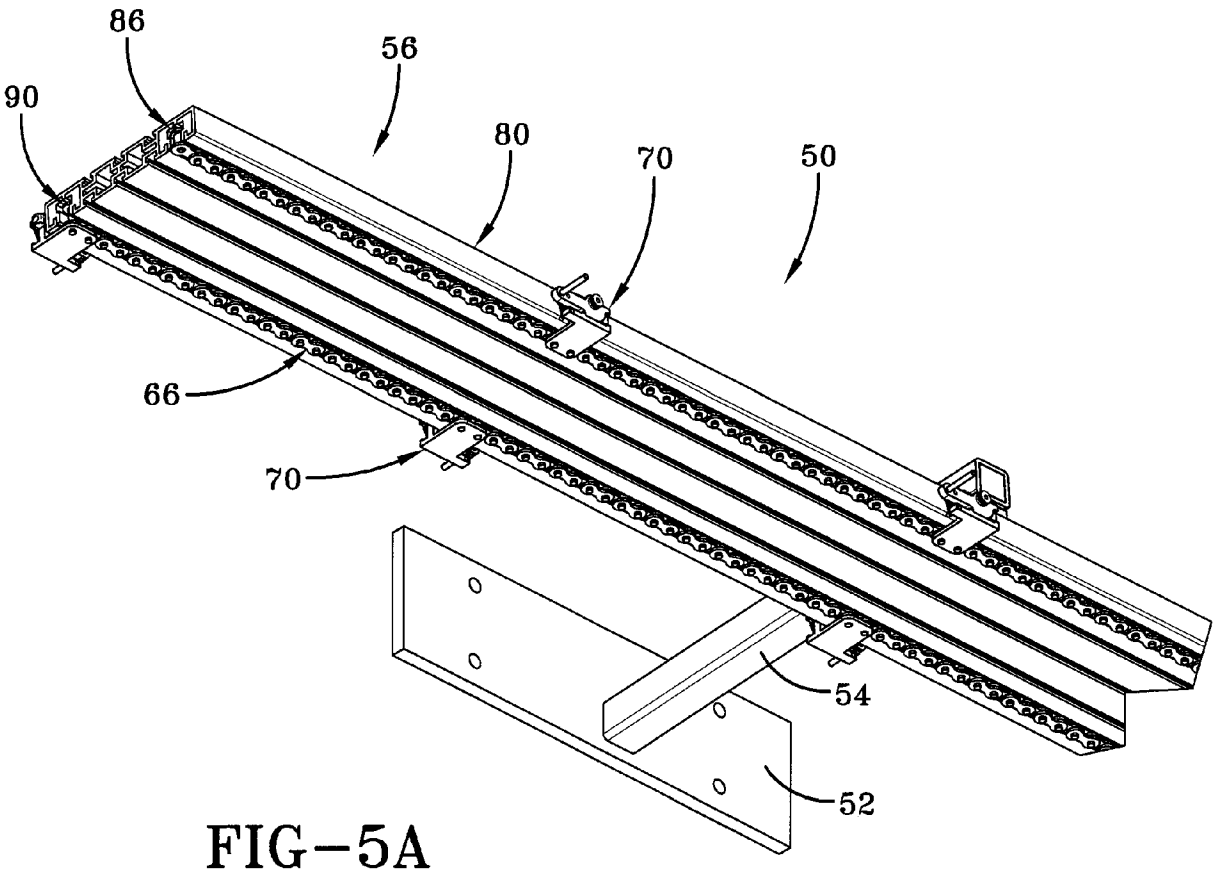
FIGS. 5A and 5B respectively show bottom and top perspective views of a portion of the creel threader according to the concepts of the present invention.
Figure 5B:
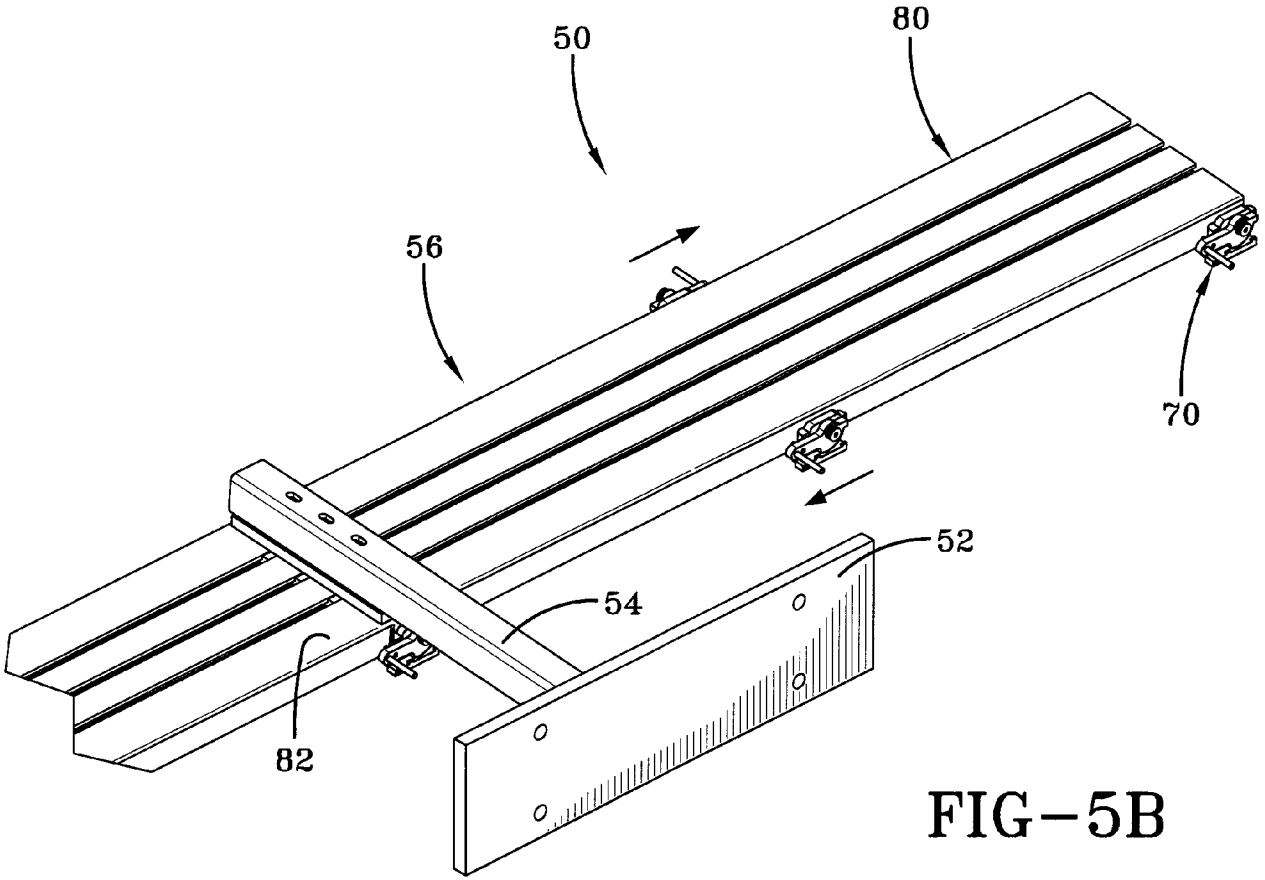
Figure 6:
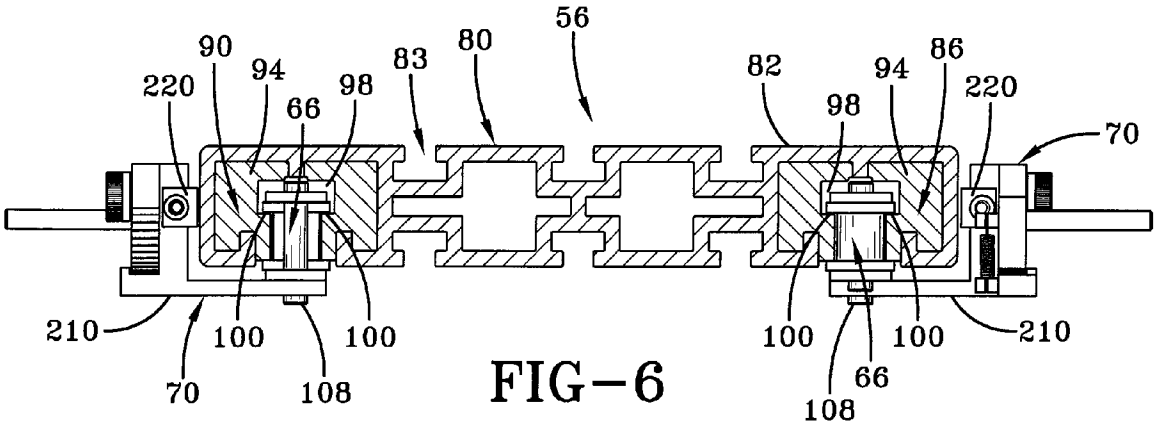
FIG. 6 is a cross-sectional view of a chain guide utilized in the creel threader according to the concepts of the present invention.

As best seen in FIGS. 2A, 2B and 3, each spool 24 maintains a filamentary material 32 which may be up to 0.250 inches in diameter and may be, but is not limited to, a steel cord, polymeric material, cloth, uninsulated wire, strand, wire or the like. In any event, the filamentary material 32 is wound around and maintained on the spool 24. FIGS. 2A and 2B show the spools only partially loaded with filamentary material while FIG. 3 shows the spools fully loaded with filamentary material. A spindle 36, which may have an associated tension controller 38, is associated with each spool 24 that is loaded onto the creel 20. Each spindle 36 may extend substantially perpendicularly from any one of the members that make up the frame 22. Skilled artisans will appreciate that the spool is slidably received and rotatable on the spindle. The tension controller, if provided, maintains uniform tension during operation of the creel system and exemplary controllers are disclosed in U.S. Pat. No. 3,899,143 and U.S. Pat. No. 8,500,056 both of which are incorporated herein by reference. Each tension controller may have a guide roller 40 that supports the filamentary material 32. The frame 22 may also provide a plurality of support rollers 42, which may extend in the same general direction as the spindles, wherein the support rollers are utilized to keep the filamentary material from sagging into other spools and becoming tangled therewith. Accordingly, in most embodiments, a support roller 42 may be provided along each row for about every five spools. Of course, any number of support rollers may be employed.

A creel threader 50 is secured to the frame 22 by a plurality of mounting brackets 52. The mounting brackets 52 may be constructed so as to allow for attachments to the horizontal and vertical members of the frame 22 without requiring modification to the frame. The mounting brackets 52 include at least one substantially perpendicularly extending support arm 54 which extends into the space between the respective rows of spools and in a space above a top row of spools or, in some embodiments, in a space below a bottom row of spools. Each row of support arms 54 carry a chain guide 56. In particular, an underside of the support arms carry the chain guide 56 which may be provided in a number of mating sections along the entire length of the row of spools. Skilled artisans will appreciate that, in most embodiments, one creel threader 50 is maintained for each row of spools and that the creel threader is positioned to be aligned in proximity to a top edge of each row of spools. In some embodiments the creel threader 50 may be positioned underneath a row of spools if so desired. In such an embodiment, the wire let-off of the controller is on the bottom in relation to the spool instead of the top. As a result, the creel threader would be inverted and the associated gripping devices, also referred to as grippers,—to be discussed—will be provided on a top front edge of the creel threader instead of a bottom lower edge.

As best seen in FIGS. 2A, 2B, 3, 4A, 4B, 5A and 5B, each creel threader 50 includes a motor drive assembly 60 which may be maintained at one end of the chain guide 56. The motor drive assembly 60 is supported by a bracket and arm assembly 62 wherein the motor drive assemblies for each row are typically maintained at the rear of the creel. In other words, the rear of the creel is considered opposite the output end of the creel which is closest the organizer 28 and further manufacturing stations. At the opposite end of the chain guide, away from the motor drive assembly 60, the creel threader 50 includes a return sprocket assembly 64 which is supported by another bracket and arm assembly 62. Each bracket and arm assembly 62 may extend from any one of the members that make up the frame 22.

An attachment chain 66 is maintained between the motor drive assembly 60 and the return sprocket assembly 64. The attachment chain 66, as used herein, is a continuous endless loop or endless cable driven by the motor drive assembly 60 and returned by the return sprocket assembly 64. The attachment chain 66 carries at least one wire cam gripper designated generally by the numeral 70. In most embodiments, the attachment chain 66 carries a plurality of grippers 70 that correspond to the number of spools maintained in a row on the creel. Moreover, the grippers may be spaced in a manner similar to the center-to-center spacing of the spindles maintained in a row. A controller 74 (best seen in FIG. 2A), which in most embodiments is maintained at the rear of the creel, generates and provides operational instructions which may be sent to each motor drive assembly and other components while also receiving input from other sensors and features maintained by the creel system 20 and/or creel threader 50 so as to facilitate their operation. Skilled artisans will appreciate that the controller 74 maintains the necessary hardware, software and memory to implement operation of the creel threader 50 and the creel system 20.

Generally, the creel threader 50 operates in the following manner. A technician or operator will load a spool of filamentary wire onto each spindle. Once the spool is loaded onto the spindle, the filamentary material is threaded according to the particular tension controller, if required, associated with each spindle. Next, the filamentary wire is inserted into and secured by the gripper 70 associated with the spindle. This process, or variations thereof, is repeated for each spool and for each row of the creel. Once this loading process is completed, the grippers and secured filamentary materials are automatically forwarded to the output end of the creel. Particular details of each component of the creel threader are set out below.

As best seen in FIGS. 4A, 4B, 5A, 5B and 6, the chain guide 56 includes a body 80 which is typically constructed of extruded aluminum. Although other materials may be utilized, it is believed that the use of aluminum is ideal in view of its strength and light weight. The body 80 provides for a top surface 82 which is secured to an underside of each support arm 54 by appropriate fasteners or the like. The surface 82 may be provided with at least one channel 83 that may receive fasteners (not shown) for connection to the associated support arm 54. Maintained within the body 80 and underneath the top surface 82 is a pull side 86 and a return side 90. The pull side 86 is maintained along an edge of the body 80 closest to a tip of the spindle 36 while the return side 90 is maintained along an edge of the body 80 closest to the frame 22. Each side 86, 90 provides a chain channel 94 which allows for retained slidable movement of the attachment chain 66. Each chain channel 94 maintains a chain cavity 98 to receive the chain wherein the cavity 98 is formed by internal facing ledges 100 that slidably support at least an upper portion of the attachment chain. Skilled artisans will appreciate that the chain channel 94 may include an ultra-high molecular weight polyethylene (UHMWPE) to form the chain cavity 98 which provides for a low coefficient of friction and superior corrosion resistance and excellent abrasion resistance properties. Of course, other embodiments may use other materials for the channels with similar properties. In some embodiments, a lubricant may be maintained within the cavity 98 so as to facilitate slidable movement of the chain 66.

Figure 7:
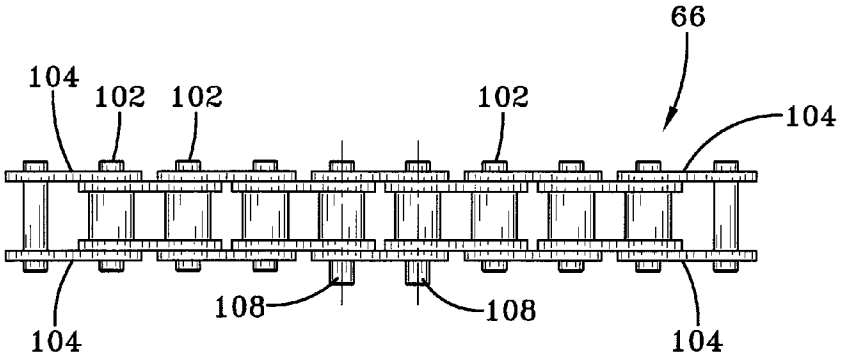
FIG. 7 is an elevational view of an attachment chain utilized in the creel threader according to the concepts of the present invention.

The attachment chain 66, which may also be referred to as a loop, is provided in an appropriate length depending upon the length of the rows carrying the spools. In any event, as best seen in FIG. 7, the chain is of a fairly standard construction made up of pins 102 with opposed ends wherein the ends of the pins are connected to one another by pivotable links 104. As such, the chain 66 is an endless loop with flexibility to allow for movement of the attached links 104 between the motor drive assembly and the return sprocket assembly. The attachment chain 66 may include at least one pair of extended pins 108 which extend through one side of their respective link, wherein the pair of extended pins are associated with a corresponding cam gripper 70. These pairs of extended pins 108 may be grouped and spaced according to the spacing required by the spacing of the spindles and associated loaded spools.

Figure 8:
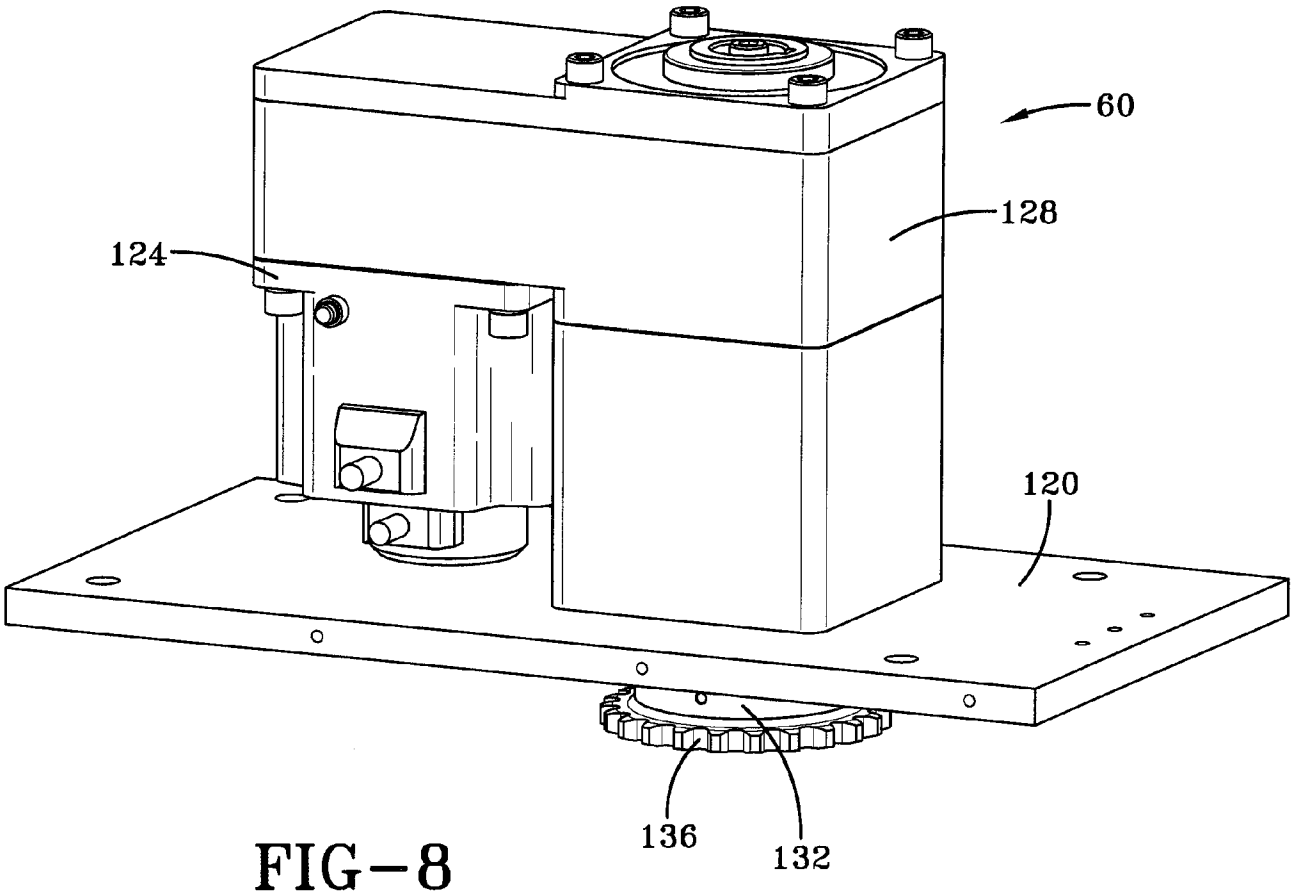
FIG. 8 is a perspective view of a motor drive assembly utilized with the creel threader according to the concepts of the present invention.

Referring now to FIG. 8, the motor drive assembly 60, which is maintained at the rear end of the creel, includes a mounting plate 120 that may be secured to the adjacent bracket and assembly 62 and/or the frame 22. The mounting plate 120 carries a servo-motor 124 that is connected to and operated by the controller 74. As seen in FIGS. 1 and 2A, the controller 74 is maintained in fairly close proximity to the motor drive assemblies and wherein the controller is maintained within a cabinet or box mounted to the frame. In any event, the servo-motor 124 is coupled to a gear reducer 128 which, in turn, rotates a drive shaft 132. The drive shaft 132 extends through the mounting plate 120 and maintains a drive sprocket 136 which meshes with the openings between the pins 102 of the attachment chain 66. Accordingly, rotation of the drive sprocket 136 by the servo-motor 124 results in movement of the chain from the drive assembly toward the return sprocket assembly 64. The drive sprocket 136 is aligned such that the chain transfers from the drive sprocket and is received within the pull side 86 and in particular the chain cavity 98 maintained by the pull side. In a similar manner the chain 66 is carried and returned in the return side 90 and the associated chain cavity 98 which is also in alignment with a diametrically opposed side of the drive sprocket 136.

As noted previously, the return sprocket assembly 64 is maintained at the end of the chain guide 56 opposite the motor drive assembly 60. In a manner similar to the drive assembly, the sprocket assembly 64 may be carried by the adjacent bracket and arm assembly 62 and/or the frame 22.

Figure 9:
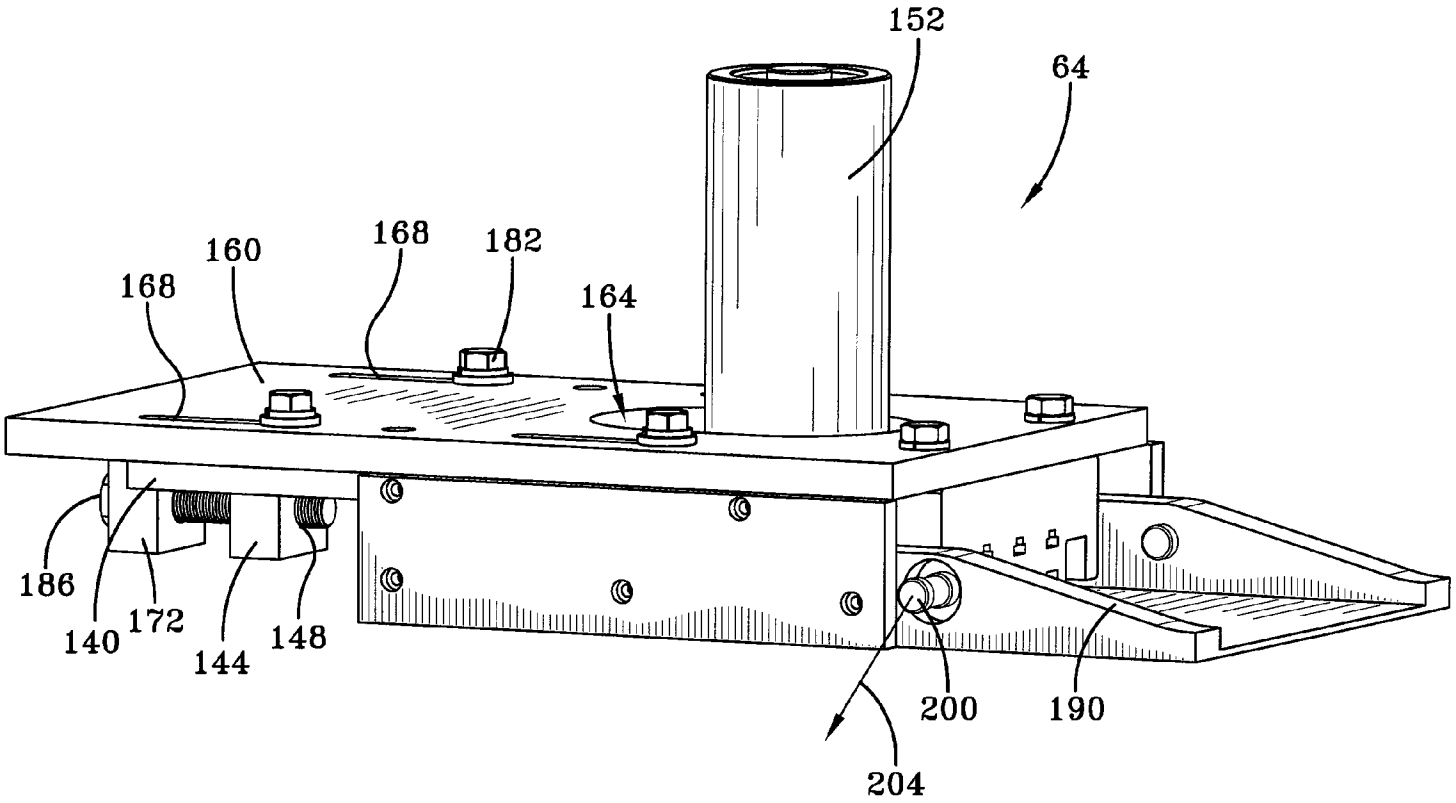
FIG. 9 is a perspective view of a return sprocket assembly utilized with the creel threader according to the concepts of the present invention.
Figure 10:
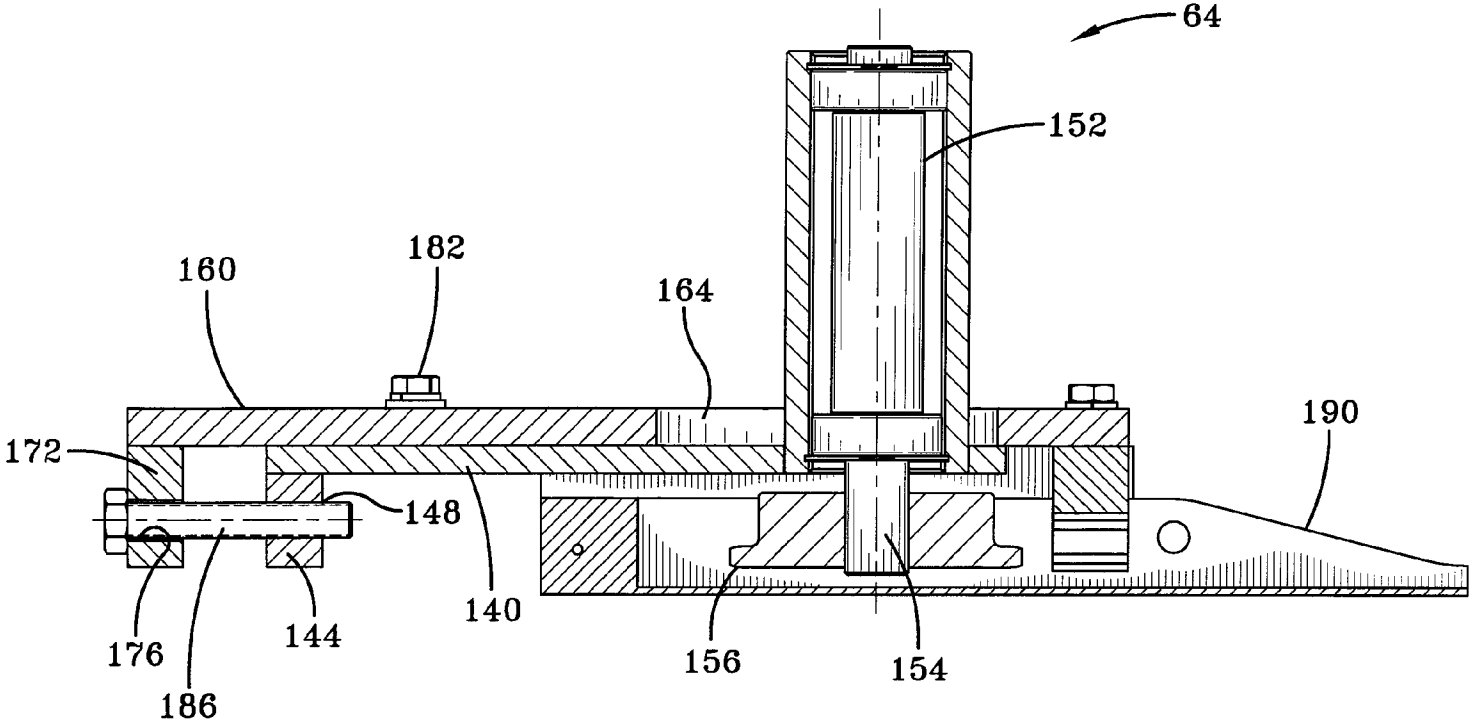
FIG. 10 is a cross-sectional view of the return sprocket assembly.
Figure 11A:
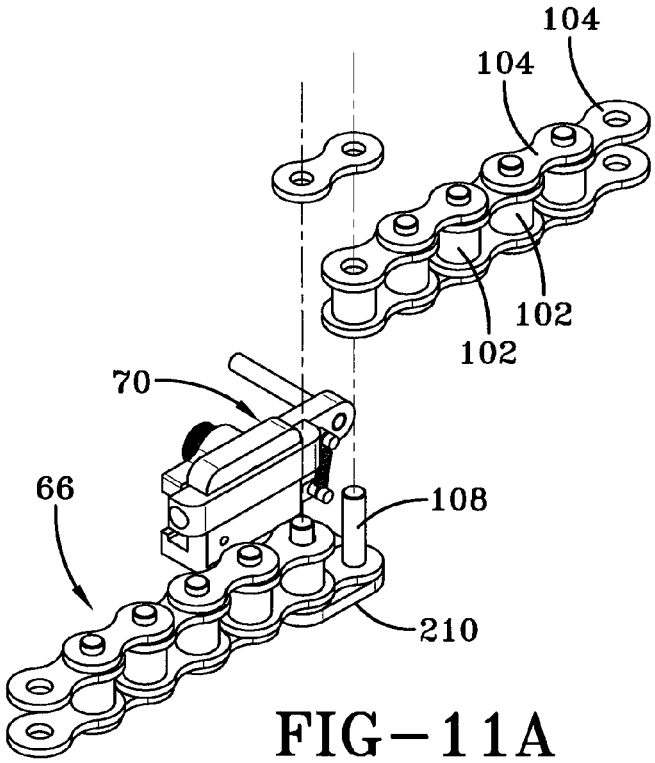
FIG. 11A is a partial exploded perspective view of a wire cam gripper assembled to the attachment chain utilized in the creel threader according to the concepts of the present invention.
Figure 11B:
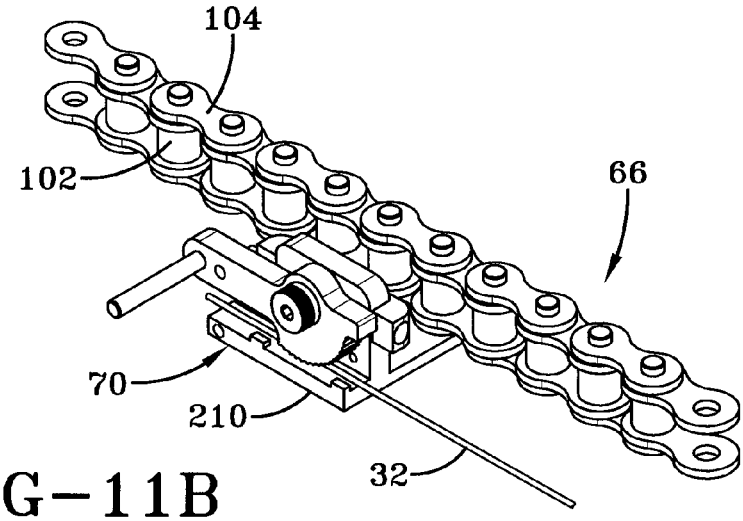
FIG. 11B is a partial perspective view of the wire cam gripper assembled to the attachment chain utilized in the creel threader according to the concepts of the present invention.
Figure 12A:
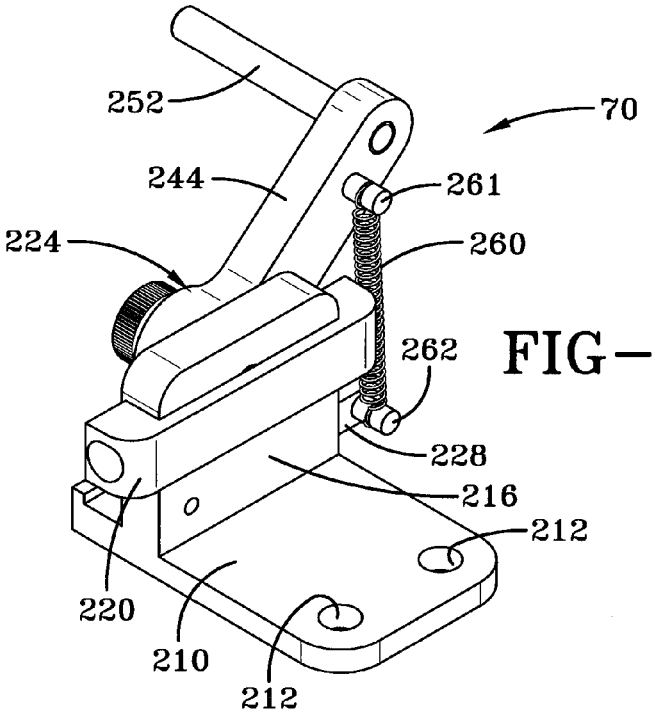
FIG. 12A is a front perspective view of the wire cam gripper shown in an open position according to the concepts of the present invention.
Figure 12B:
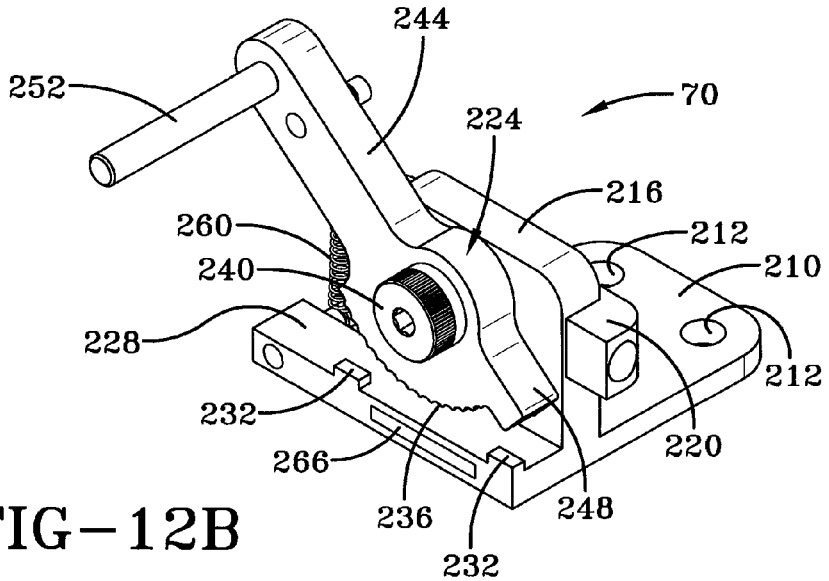
FIG. 12B is a rear perspective view of the wire cam gripper shown in an open position according to the concepts of the present invention.

As best seen in FIGS. 9 and 10, the sprocket assembly 64 includes a base plate 140. The base plate 140 includes a base flange 144 which has a threaded flange hole 148 extending therethrough. A bearing assembly 152 is supported by the base plate 140 and maintains a shaft 154 extending therethrough, wherein a chain sprocket 156 is carried by and rotatable with the shaft 154. The chain sprocket 156 receives the attachment chain 66 and meshes with the openings between the links 104 in a manner similar to the drive sprocket 136.

A tension plate 160 is maintained adjacent to and in bearing contact with the base plate 140. Moreover, the tension plate 160 is secured to the bracket and arm assembly 62 and/or the frame 22. The tension plate 160 includes a bearing opening 164 so as to allow the bearing assembly 152 to extend therethrough. The tension plate also includes a number of slots 168 which may extend in a direction substantially parallel to the length of the chain guide. A tension flange 172 may extend substantially perpendicularly from the plate 160 in the same direction that the base flange 144 extends from the base plate 140. The tension flange 172 may include an unthreaded flange hole 176 extending therethrough that aligns with the flange hole 148. A plurality of locking screws 182, which may include a number of washers, extend through the slots 168 and are received in corresponding openings maintained by the base plate 140. The locking screws 182 hold the tension plate 160 adjacent the base plate 140. A chain tension fastener 186, which is typically in the form of a threaded screw, extends through the flange hole 176 into the flange hole 148. Skilled artisans will appreciate that an end of the chain in an unassembled condition is fed through the chain cavities 98 and then assembled onto the drive sprocket and then wrapped around the chain sprocket 156. The ends of the chain are then connected to form an endless loop. Once the chain is installed, the locking screws 182 are directed through the slots 168 and received in the corresponding fastener holes in such a manner so as to secure the tension plate 160 to the base plate 140. Prior to securement of the tension plate to the base plate, the chain tensioner fastener 186 is positionally adjusted so as to provide the proper tension force to the attachment chain between the motor drive assembly 60 and the return sprocket assembly 64. This is done so as to allow for repeatable and accurate movement of the grippers as the chain moves from the pull side 86 to the return side 90.

Associated with the return sprocket assembly 64 is a cam entry ramp 190 which engages the cam gripper 70 as will be discussed. Associated with the cam entry ramp 190, in proximity to the pull side of the chain guide, may be a proximity sensor 200 which generates a sensor output 204 that is sent to and received by the controller 74. In the present embodiment the proximity sensor is an inductive sensor which senses the presence and passing of each gripper 70. Of course, other types of sensors may be employed to detect the presence and/or passing of the cam gripper.

Referring now to FIGS. 11A, 11B, 12A, 12B, 13A and 13B, the wire cam gripper 70 is shown in further detail. Each gripper 70 includes a travel plate 210 having a pair of holes 212 extending therethrough which receive corresponding extended pins 108 of the attachment chain 66 (see FIGS. 11A and 11B). Extending substantially perpendicularly from the travel plate 210 is a cam plate 216 which has disposed on one side thereof a wear guide 220. The wear guide 220, when the cam gripper 70 is assembled to the chain and the chain is received in the chain cavities 98, is adjacent to and may bear against an outer side of the body 80 (best seen in FIG. 6). As such, the wear guide 220 maintains the necessary spacing and orientation between the cam gripper 70 and the chain guide 56 while maintaining a desired orientation of the travel plate 210 in relation to the filamentary material to be pulled.

A cam 224 may be rotatably secured to the cam plate 216. The travel plate 210 maintains a wire ledge 228 on a side of the travel plate opposite the wear guide 220. In some embodiments, at least one upwardly extending guide lip 232 extends from the wire ledge 228 so as to facilitate retention of the filamentary material that is received between the cam 224 and the wire ledge 228. The cam 224 may include a curved, ridged or serrated grip surface 236 that faces the wire ledge 228. A pivot fastener 240 extends through the cam 224 and is attached to the cam plate 216 so as to allow for retained and pivotable movement of the cam 224. The pivot fastener 240 serves as a pivot point or rotatable center for the cam 224 and as a center point in relation to the grip surface 236. As will be discussed further, with the ledge 228 serving as a reference point, the distance from the pivot point to the grip surface changes as the cam rotates. In other words, the distance between the pivot point and the grip surface varies depending upon the angular orientation of the cam. Extending from the cam 224 is a lever arm 244. A stop lever 248 extends from the cam 224 in a direction opposite the lever arm 244. Extending substantially perpendicularly from the lever arm 244 is a handle 252. A spring 260 provides one end connected to a pin 261 extending from the lever arm 244 and an opposite end connected to a pin 262 extending from the wire ledge 228. A stop pin 264 may also extend substantially perpendicularly from the cam plate 216 in such manner that full rotation of the cam 224 is blocked by contact of the stop lever 248 with the stop pin 264. In some embodiments indicia 266 may be provided on the cam gripper 70 and, in particular on the travel plate 210 and/or the cam plate 216. Use of the marking indicia 266 may facilitate loading of the filamentary wire into the gripper and may also facilitate association of the gripper 70 with a particular location in the row of spools and/or with a particular spool in a row.

Figure 13A:
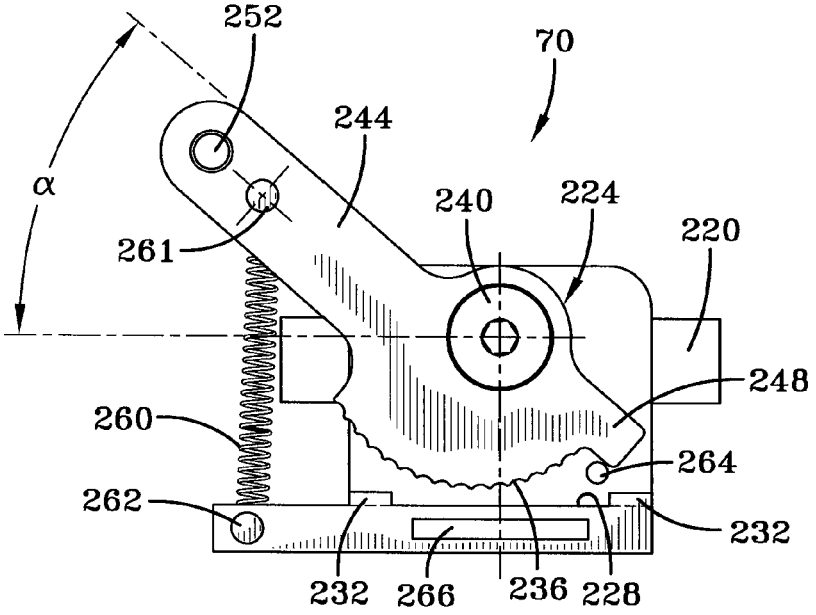
FIGS. 13A and 13B are elevational views of the wire cam gripper shown in different operational positions according to the concepts of the present invention.
Figure 13B:
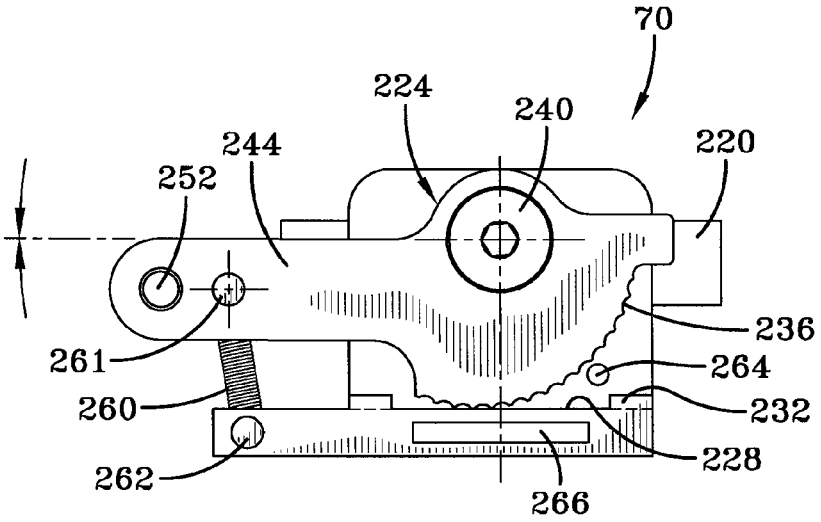
Figure 14:
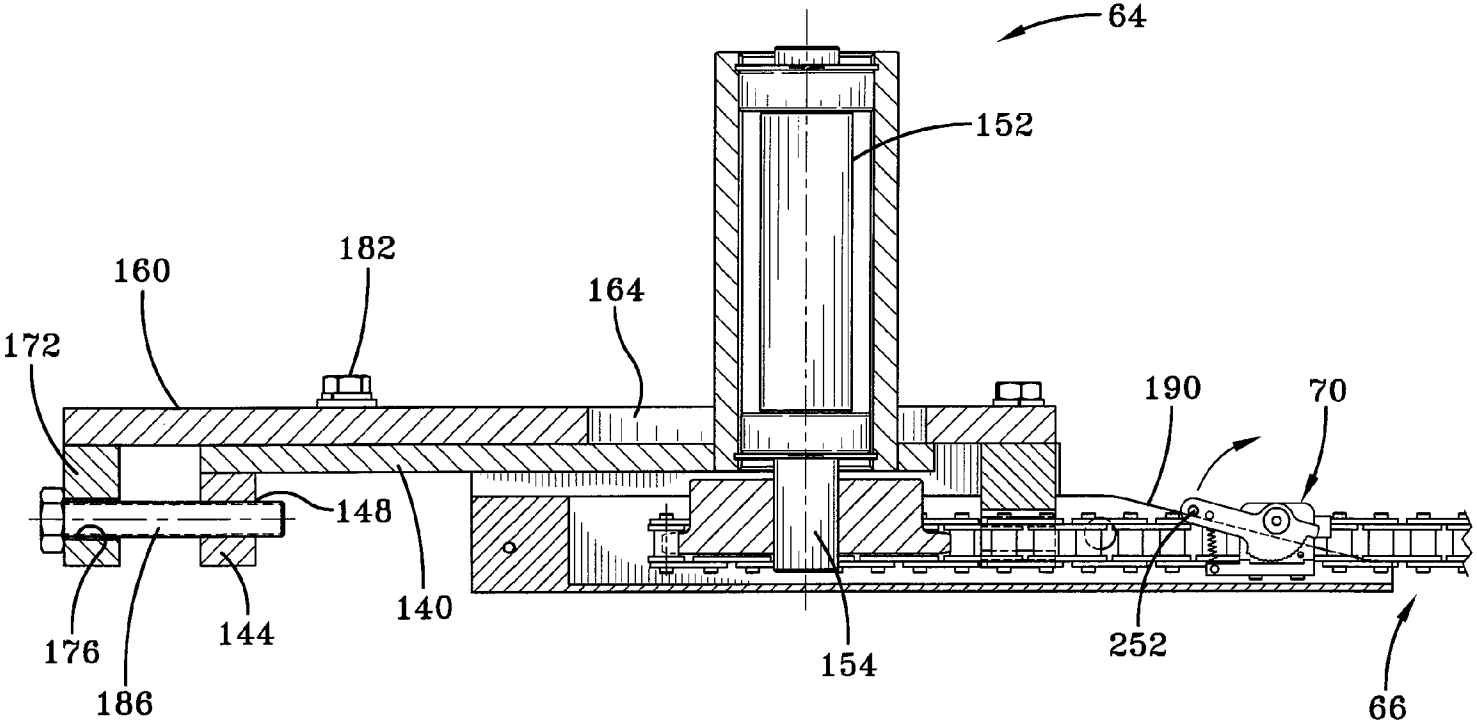
FIG. 14 is a cross-sectional view of the return sprocket assembly and a wire cam gripper associated therewith according to the concepts of the present invention.

As best seen in FIG. 13A, the cam gripper 70 is shown in an open position so as to allow for entry of the filamentary material between a space defined between the ridged grip surface 236 and the wire ledge 228. In most embodiments, a technician will manually move the lever arm 244 to overcome the spring force and hold the lever arm at or in close proximity to an angular position a. The angular position a in one embodiment is about 45°. In other embodiments, the angular position a may be in the range of 30° to 60°. In the present embodiment, the angle $\alpha$ is controlled by the positioning of the pin with respect to the center point of the pivot fastener 240. In some embodiments, the filamentary material is inserted axially between the grip surface and the wire ledge and in other embodiments the filamentary material may be inserted laterally. The technician may release the handle 252 so as to allow the cam 224 to rotate in a counter-clockwise manner by virtue of the spring force of the spring 260 to secure the filamentary material such that the grip surface 236 engages the filamentary material and holds it against the wire ledge 228. Skilled artisans will appreciate that the spring, the ridged grip surface and the pivot fastener provide forces sufficient to hold the filamentary material and provide a sufficient pulling force so as to maintain capture of the filamentary material in the gripper 70 as it moves along the chain guide 56. As a safety and operational feature shown in FIG. 14, the travel of the cam gripper into the return sprocket assembly will result in the cam gripper automatically moving to an open position so as to release the filamentary material from the cam gripper. In particular, the handle 252 of the cam gripper 70 is engaged by the cam entry ramp 190 so as to move the handle clockwise and the cam into an open position. This movement allows for release of the filamentary material so that it is maintained at the organizer end of the creel and prevents the cam gripper from taking the filamentary material around the sprocket assembly and tangling with other filamentary materials or the return sprocket assembly 64. The automated release of the filamentary material may be employed instead of requiring a technician to manually move the handle 252. If enabled, the cam gripper may be stopped by the controller 74 after the subsequent detection of the gripper by the proximity sensor 200. Rotation of the handle 252 must be sufficient to overcome the spring force, the gripping force, in order to release the filamentary material from the gripper 70.

Figure 15:
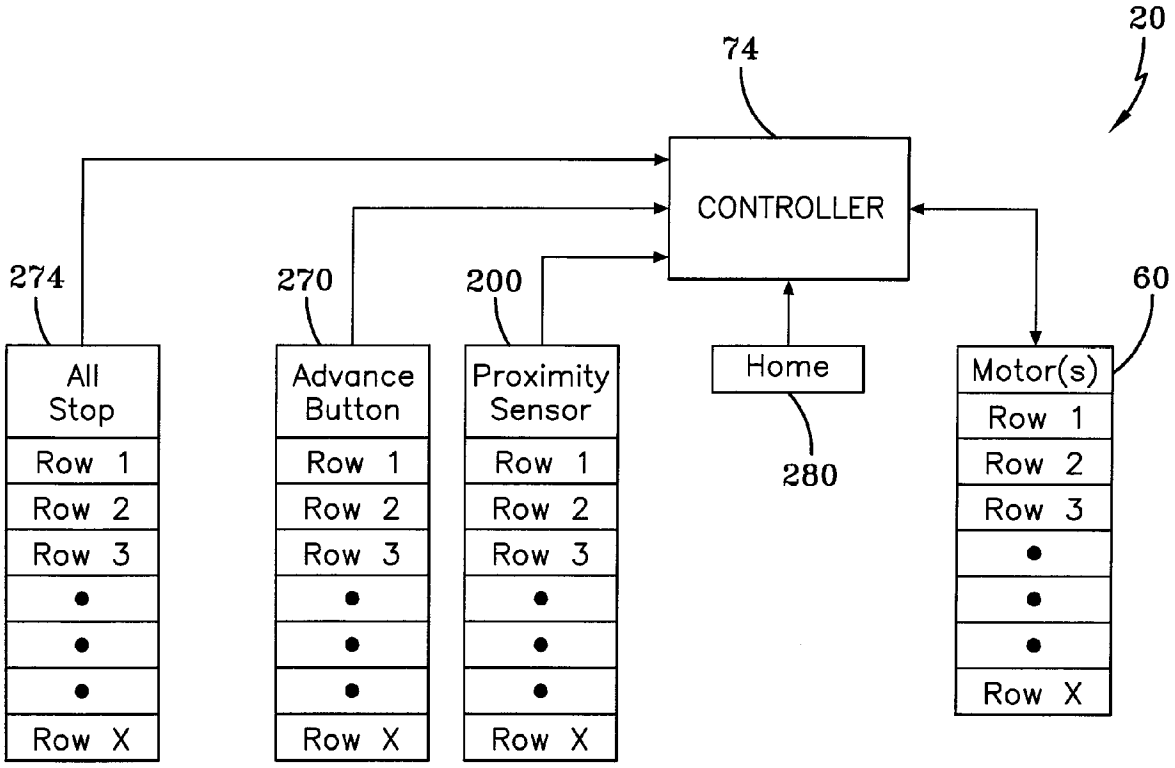
FIG. 15 is a schematic diagram of the operational components of the creel system according to the concepts of the present invention.

As seen in FIGS. 2B and 15, an advance button 270 may be maintained at the output end of the creel near each row of spools and associated creel threader 30. The advance button 270 is connected to the controller 74 such that actuation of the advance button initiates the corresponding motor drive assembly which results in movement of the chain and associated cam grippers 70. Depending upon user preference, and as set in the controller 74, actuation of the advance button 270 may result in a predetermined amount of movement of a cam gripper in its designated incremental spacing, wherein a single actuation of the button moves a cam gripper toward the organizer. In another embodiment, actuation of the advance button 270 may initiate a speed regulated movement of the chain. In either configuration, the technician may move the handle clockwise to release and remove the filamentary material from the cam gripper and insert it into the organizer in sufficient time to allow the operator to pick up the next filamentary material from the next-in-line cam gripper. A stop button 274 may be provided near the advance button wherein actuation of the stop button causes all of the motor assemblies to stop rotation and, as such, stop movement of the cam grippers. In one embodiment, the controller 74 and the advance buttons may be programmed so that actuation of a single advance button 270 will cause all of the motor assemblies or predetermined motor assemblies to move their associated grippers continuously or a predetermined distance. In other embodiments, the controller 74 and the stop buttons 274 may be programmed so that actuation of any one of the stop buttons stops all of the motor assemblies. Other embodiments may provide that the controller is associated with an ALL stop button, which stops all the motor controllers, and/or a home button 280, which is connected to the controller, and which moves all of the cam grippers to a pre-determined location such as, for example, in close proximity to positions near corresponding spools. If appropriate, the proximity sensor 200 may detect passage of the cam gripper and automatically cause the controller to stop operation of the servomotor and movement of the chain.

Referring now to FIG. 15, a schematic diagram shows the operational relationship of selected components of the creel threader 50. As can be seen, the controller 74 generates signals that are received by the drive motors 60 in each of the rows of the creel system. Skilled artisans will appreciate that the drive motors may provide feedback as to the forces required to operate the motors. For example, each servomotor 124 may generate a pull-off force that is detected by the controller 74. The values of the pull-off force may be monitored and excess values may be indicative of filamentary material entanglements or other problems associated with the creel threaders. If a threshold value for the pull-off force is exceeded, then the controller may initiate an automated shut down routine. Additionally, the pull-off force values could be stored for later quality control analysis. The controller 74 may also receive input from the proximity sensors 200 associated with each of the return sprocket assemblies 64. The controller may also receive input from an advance button 270 for each of the rows provided by the creel system. Accordingly, actuation of an advance button for row 1 will be sent to the controller 74 which will initiate movement of the motor drive assembly associated with row 1. If desired, the advance button 270 may initiate continuous slow movement of the motor drive assembly so as to slowly move the attachment chain and associated wire cam grippers as previously described. In an alternative embodiment, actuation of the advance button may move the chain 66 a predetermined amount and then stop. Or the cam gripper movement could be stopped by the controller 74 when passage of the cam gripper 70 is detected by the proximity sensor 200. The technician would then pick up the filamentary material and load it into the organizer 28. In some embodiments, actuation of the advance button may be used to move the grippers in each row.

Based on the foregoing description, the operation of the creel threader is readily apparent. The cam grippers 70 are moved into a predetermined position, such that each gripper is associated with a corresponding spool. To ensure proper organization of the filamentary material into the organizer, the indicia 266 on each gripper is used in aligning each gripper with a corresponding spool. Next, the technician loads the wire from the spool, through the appropriate tension controller 38, if required, and axially into the cam gripper 70 between the space between the stop pin 264 and the wire ledge 228. In the alternative, the technician may lift the handle and laterally insert the wire into the cam gripper. Either way, the handle is then moved counter-clockwise to fully grasp the filamentary material between the gripper surface 236 and the wire ledge 228. The loading operation is then completed for all of the spools along a row or it may be completed for all of the rows in the entire creel. Next, the operator actuates the advance button 270 for a selected row or rows and the controller initiates movement of the grippers so as to deliver the filamentary material closest to the organizer to the organizer first. Accordingly, each filamentary material from the spool will be advanced the required distance. The technician will then take the filamentary material, after it has been manually or automatically released from the gripper, and then loads each filamentary material into its proper position into the organizer. This is repeated for each row if desired, or all the grippers in all the rows may be incrementally loaded into the organizer after each incremental stop. In any scenario mentioned, after the first wire is loaded in the organizer, the technician then advances the grippers incrementally or for a single row, continuously and then receives the next wire from the next cam gripper and loads it into its proper position in the organizer. The incremental or continuous movement of the cam grippers continues until all filamentary materials are loaded into the organizer. The technician will then move the filamentary materials form the organizer to the calender or other manufacturing equipment for loading and processing in the normal fashion. Once the calender or other processing equipment is started, then the filamentary materials are pulled from the spools through the organizer in a well known manner. Prior to the operation of the calender, movement of the cam grippers may be disabled and do not interfere with movement or operation of the filamentary materials.

The advantages of the present invention are readily apparent. The creel threader provides for an automated system which precludes the need for manual movement of each wire from a spool to the organizer. This maintains a clear organization of the filamentary materials and facilitates their loading into the organizer. This saves significant amounts of operational set-up time and it is believed may eliminate the need for a second creel to be maintained by the manufacturer. In other words, with the automated process, it is believed that a creel can be quickly loaded, thus obviating the need to have an operator manually thread an organizer while the other creel is supplying materials to the calender. Further advantages of the present invention allow for the servo-motor to maintain and monitor the pulling forces utilized by each creel threader. As such, any significant changes in the pulling forces can be detected and allow for investigation as to any tangling or operational difficulties.

Thus, it can be seen that the objects of the invention have been satisfied by the structure and its method for use presented above. While in accordance with the Patent Statutes, only the best mode and preferred embodiment has been presented and described in detail, it is to be understood that the invention is not limited thereto or thereby. Accordingly, for an appreciation of the true scope and breadth of the invention, reference should be made to the following claims.

What is claimed is:

1. A creel threader for use with a creel system that holds a plurality of spools wherein each spool carries a filamentary material, the creel threader comprising:

a guide supported by the creel;

an endless loop carried by said guide;

a drive assembly coupled to said endless loop;

at least one gripper carried by said endless loop, said at least one gripper receiving the filamentary material from at least one of the spools, and said drive assembly moving said at least one gripper and the received filamentary material from the spool to an output end of the creel system for further processing;

a return assembly coupled to said endless loop, said return assembly disengaging said at least one gripper from the filamentary material to allow further processing;

a controller connected to said drive assembly; and a proximity sensor associated with said return assembly and connected to said controller, said proximity sensor detecting passage of said at least one gripper and sending a signal to said controller.

2. The creel threader according to claim 1, wherein said at least one gripper comprises:

a cam plate;

a cam rotatably mounted to said cam plate, the filamentary material received between said cam and said cam plate; and a handle extending from said cam; and wherein said return assembly comprises:

a ramp, wherein said ramp deflects said handle so as to disengage said cam from the filamentary material.

3. The creel threader according to claim 2, wherein said at least one gripper further comprises:

a wear guide carried by said cam plate, said wear guide positioned adjacent said guide.

4. The creel threader according to claim 1, further comprising:

an advancement button connected to said controller, wherein actuation of said advancement button causes said drive assembly to move said at least one gripper.

5. The creel threader according to claim 4, wherein detection of passage of said at least one gripper by said proximity sensor causes said controller to stop said drive assembly.

6. The creel threader according to claim 1, wherein said drive assembly comprises a servo-motor connected to said controller, said controller monitoring a pull-off force required to move said at least one gripper with received filamentary material.

7. A method of transferring filamentary material carried on spools maintained by a creel to an organizer, the method comprising:

loading a plurality of spools that carry filamentary material on to a creel;

securing the filamentary material from at least one of said spools to at least one gripper that is carried by an attachment chain;

moving said attachment chain carrying said at least one gripper with a drive assembly and a return assembly; and releasing the filamentary material from said at least one gripper by said return assembly upon detection of said at least one gripper passing a proximity sensor which sends a signal to a controller that is connected to said drive assembly.

8. The method according to claim 7, further comprising:

associating a plurality of said grippers to said attachment chain and said at least one said drive assembly.

9. The method according to claim 8, further comprising:

collectively moving said plurality of said grippers with said drive assembly;

sequentially releasing the filamentary material from each said gripper; and loading each filamentary material into the organizer.

10. The method according to claim 8, further comprising:

linking said plurality of said grippers with said attachment chain that is coupled to said drive assembly, wherein said attachment chain and said drive assembly are associated with a row of spools carried by the creel.

11. The method according to claim 10, further comprising:

advancing said attachment chain a predetermined distance and then stopping.

12. The method according to claim 10, further comprising:

continuously advancing said attachment chain until all said grippers linked to said attachment chain have released their filamentary material.

13. An apparatus for transferring filamentary material from any number of spools to an organizer, comprising:

a creel that holds a plurality of spools wherein each spool carries a filamentary material;

at least one guide supported by said creel;

at least one drive assembly associated with said at least one guide and moving an endless loop; and at least one gripper carried by said endless loop, said at least one gripper comprising:

a travel plate connected to said endless loop, said travel plate providing a ledge;

a cam plate extending substantially perpendicularly from said travel plate; and a cam having a gripping surface, said cam rotatably mounted to said cam plate, said cam capturing lengthwise said at least one said filamentary material between said gripping surface and said ledge so that said at least one filamentary material is pulled along the direction of said endless loop's direction of travel.

14. The apparatus according to claim 13, wherein said cam is rotatable between an open position and a closed position which holds said at least one filamentary material between said gripping surface and said ledge, said at least one gripper further comprising:

a spring having one end connected to a lever arm extending from said cam and said travel plate so as to normally hold said lever arm in said closed position.

15. The apparatus according to claim 14, further comprising:

a stop lever extending from said cam in a direction away from said lever arm; and a stop pin extending laterally from said cam plate, wherein rotation of said cam to said open position is limited by engagement of said stop lever with said stop pin.

16. The apparatus according to claim 14, further comprising:

a return assembly coupled to said endless loop and positioned proximal an end of said guide adjacent the organizer; and a handle extending laterally from an end of said lever arm, said return assembly engaging said handle as said at least one gripper passes by so as to rotate said cam to the open position and release said at least one filamentary material.

17. The apparatus according to claim 16, further comprising:

a wear guide carried by said cam plate, said wear guide positioned adjacent said guide which slidably receives said endless loop.

18. The apparatus according to claim 13, further comprising:

at least one lip extending upwardly from said ledge, wherein said at least one filamentary material is positionable between said at least one lip and said cam plate.

* * * * *